United States Patent [19]

Larkin

[11] 3,954,359

[45] May 4, 1976

[54] APPARATUS FOR THE CONTINUOUS CASTING OF CONCRETE

[75] Inventor: Frank O. Larkin, York, Pa.

[73] Assignee: William T. Shields, Camp Hill, Pa. ; a part interest

[22] Filed: May 10, 1974

[21] Appl. No.: 469,426

[52] U.S. Cl. ..... 425/63; 404/98; 404/105; 425/456

[51] Int. Cl.[2] ..... B28B 13/02

[58] Field of Search ..... 425/59, 63–65, 425/219, 432, 456; 404/96–98, 105, 106

[56] References Cited

UNITED STATES PATENTS

| | | | |
|---|---|---|---|
| 3,292,511 | 12/1966 | Cheney | 404/98 |
| 3,606,827 | 9/1971 | Miller et al. | 404/98 |
| 3,635,131 | 1/1972 | Larsen et al. | 404/98 |
| 3,710,695 | 1/1973 | Miller et al. | 404/98 |
| 3,779,661 | 12/1973 | Godbersen | 404/98 |
| 3,779,662 | 12/1973 | Smith | 404/98 |
| 3,820,913 | 6/1974 | Miller et al. | 404/98 |

*Primary Examiner*—Francis S. Husar
*Assistant Examiner*—John McQuade
*Attorney, Agent, or Firm*—John W. Logan, Jr.

[57] ABSTRACT

A curbing machine utilizing slip form casting of cement or concrete is disclosed which will continuously cast curbing or pavements and simultaneously with the casting operation provide the necessary expansion joints in the cast curbing. The curbing machine includes a conventional tractor with an additional speed reduction gear box. A unitary open bottom hopper and slip mold is removably and adjustably carried between the wheels of the tractor by hydraulic cylinders permitting both vertical and tilting adjustment of the mold to adjust the mold to the contour of the ground. Means are provided within the hopper and immediately in front of the slip mold to form the expansion joint in the cast curbing. In an alternate embodiment, the slip mold is mounted outboard of the tractor with hydraulic cylinders provided to raise, lower and tilt the slip mold.

4 Claims, 24 Drawing Figures

10.
5.
T
C
30
31
32
33
34
36
39a
41
42
43
44
45
46
47
48
49
52
53
56
62
63
64
65
75
76
77
78

APPARATUS FOR THE CONTINUOUS CASTING OF CONCRETE

The present invention relates to new and useful improvements in curbing machines for continuously forming, by the use of slip form casting, various types of curbing, gutters and sidewalks.

Prior to the present invention continuous casting machines have been available. These prior machines, however, were bulky, cumbersome and expensive machines, mounted on caterpillar tracks with a slip mold secured to the machine between the tracks and had limited versatility. They were suitable for traveling at the uniform slow speed required for the continuous slip mold casting of concrete but could not move rapidly from the end of one section to the beginning of the next. Also, they were difficult to steer and could not accurately form a small radius curve in a curb. Additionally, when using these prior machines, expansion joints in the formed curb had to be routed out by hand as the machines had no provision for forming the expansion joints simultaneously with the casting operation.

With the foregoing in mind, a primary object of the present invention is to provide a novel machine for continuously casting curbing or sidewalks by means of a slip mold whose position can be readily and easily adjusted during operation of the machine to cast the curbing in the desired position regardless of variations in the contour of the ground on which the curbing is formed.

Another object of the present invention is to provide a novel curbing machine of the above-described type in which the hopper and slip mold is formed as a single unit and can be quickly removed and replaced.

A further object of the present invention is to provide a novel curbing machine which will position inserts into concrete as it is being cast to automatically provide for expansion joints in the curbing during a continuous casting operation.

A further object of the present invention is to provide a novel curbing machine which will travel at the required uniform slow speed of 1 to 3 feet per minute when casting curbing but is capable of traveling close to normal road speeds to provide a minimum delay between the end of one casting operation and the start of another.

Another object of the present invention is to provide a novel curbing machine which is compact and easily handled and can be readily turned to follow a uniform radius to permit continuous casting of curbing about a relatively short radius.

A still further object of the present invention is to provide a novel curbing machine having the features and characteristics set forth above which can be manufactured easily and cheaply and is easy to maintain and use.

These and other objects of the present invention and the various features and details of the operation and construction thereof are hereinafter more fully set forth and described with reference to the accompanying drawings, in which.

Figures 4, 5:
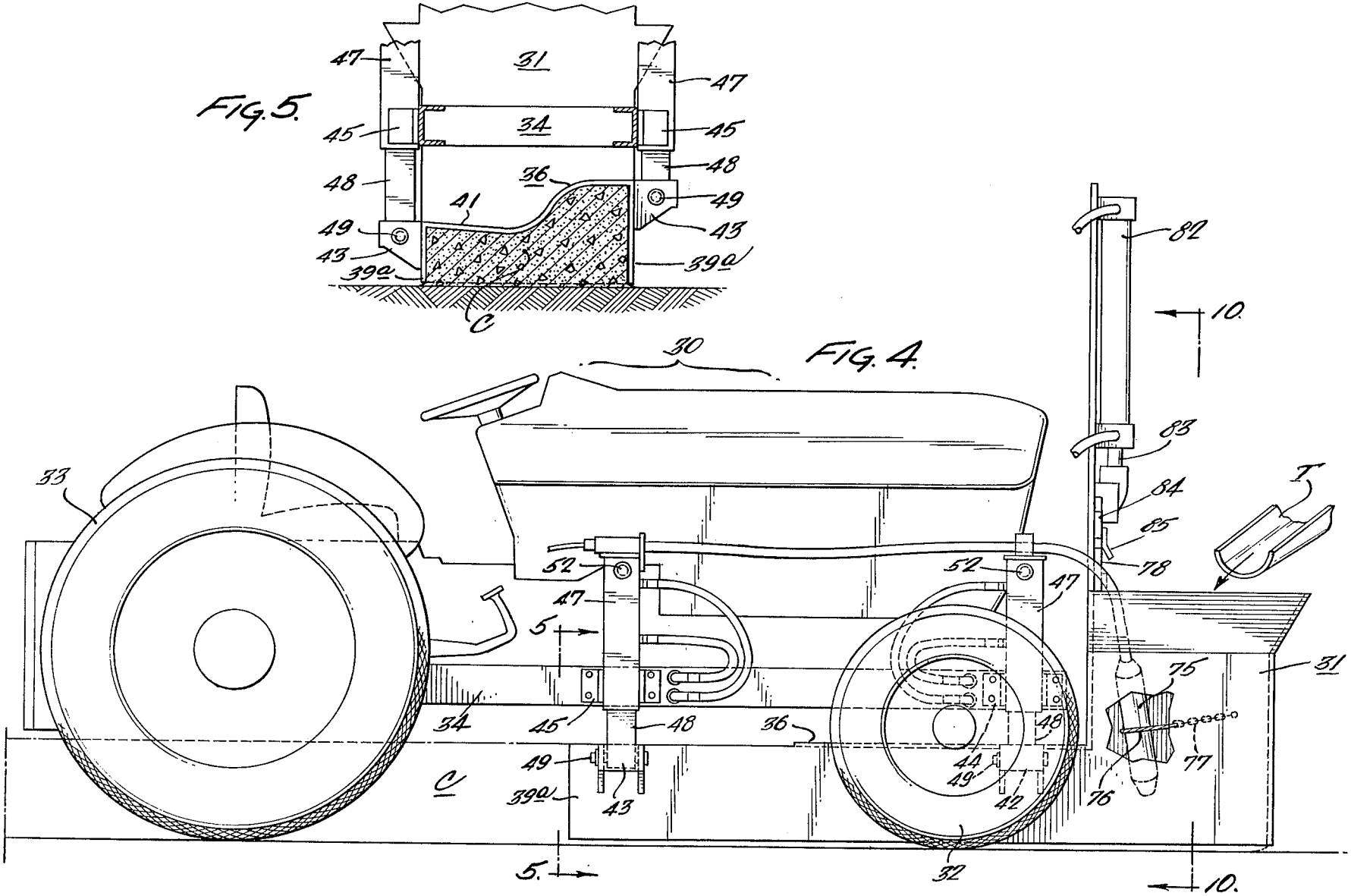
FIG. 4 is an enlarged side elevational view partially in section of the tractor and slip mold showing the means for mounting the slip mold on the tractor.
FIG. 5 is a fragmentary transverse sectional view illustrating the rear of the slip mold taken along line 5—5 of FIG. 4.
Figure 7:
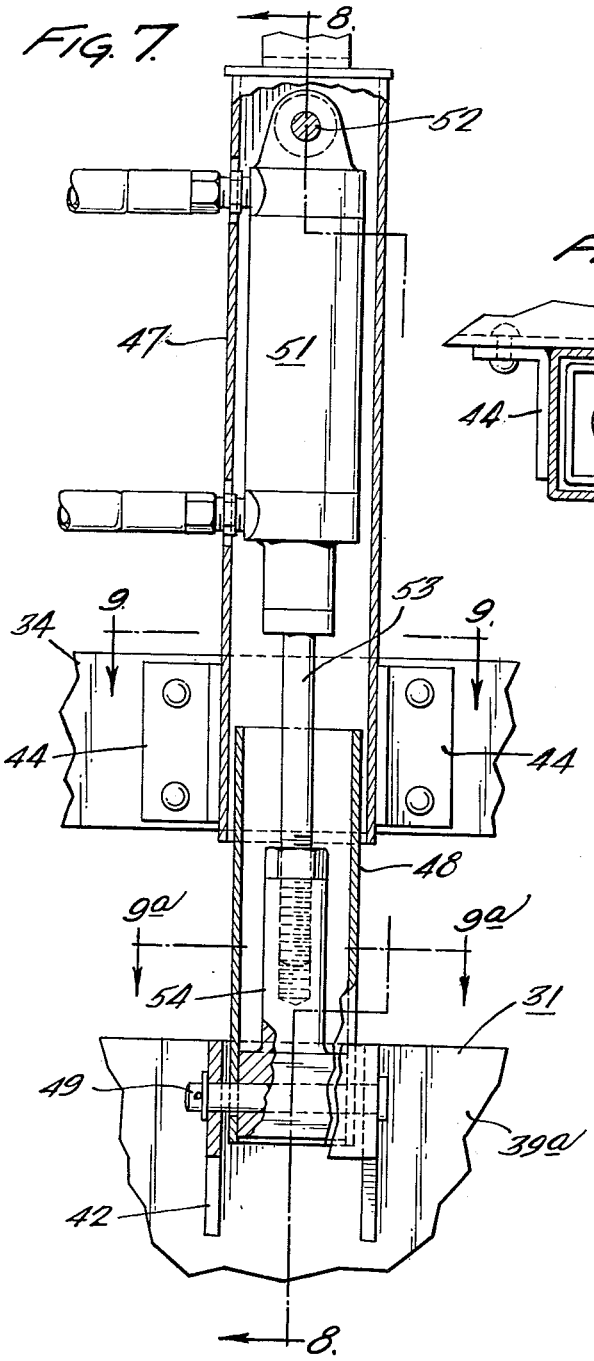
FIG. 7 is an enlarged side elevational view partially in section of the adjusting and mounting means for the slip mold.
Figure 9:
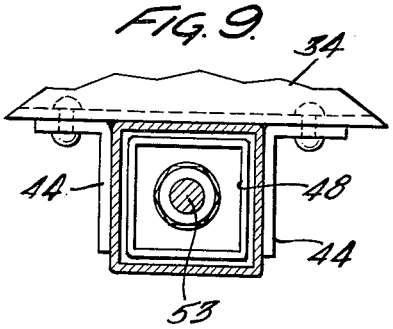
Figure 9A:
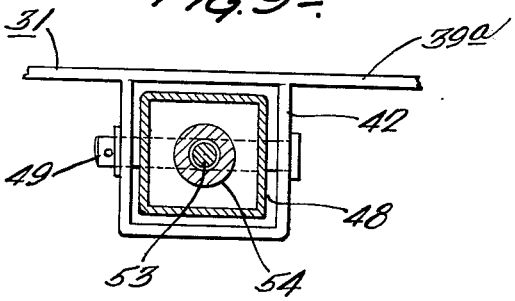
Figure 12:
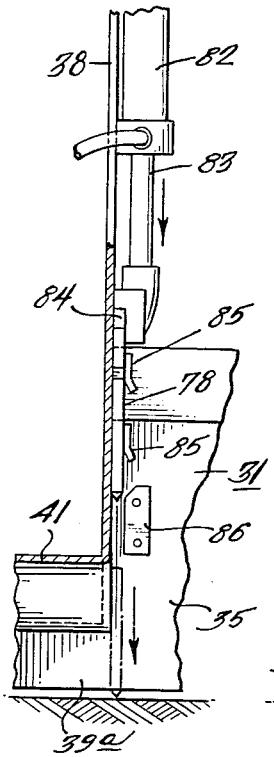
Figure 11:
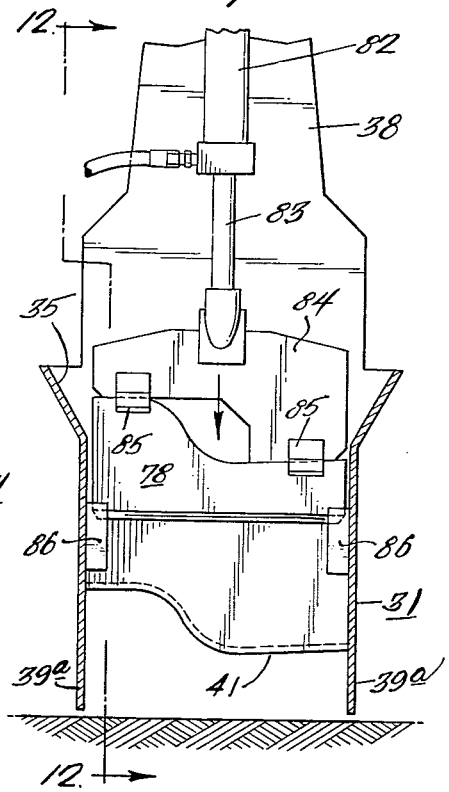
Figure 10:
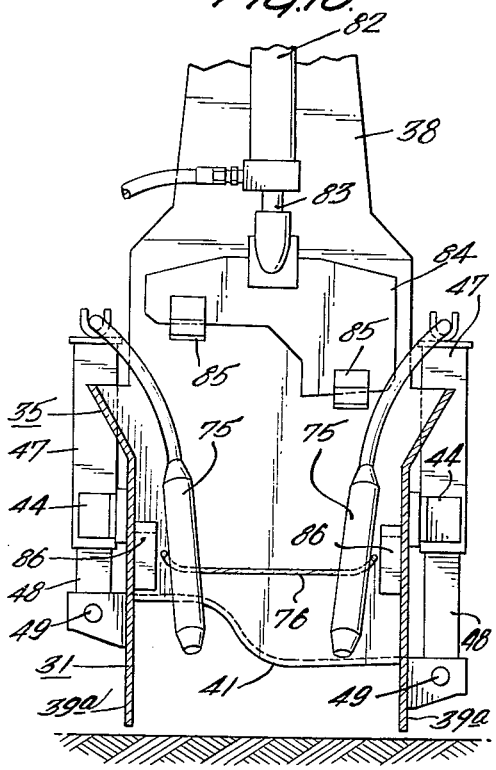
Figure 13:
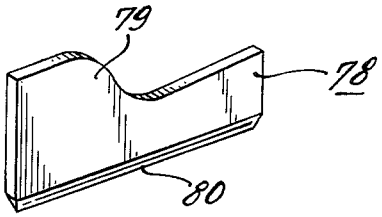
Figure 14:
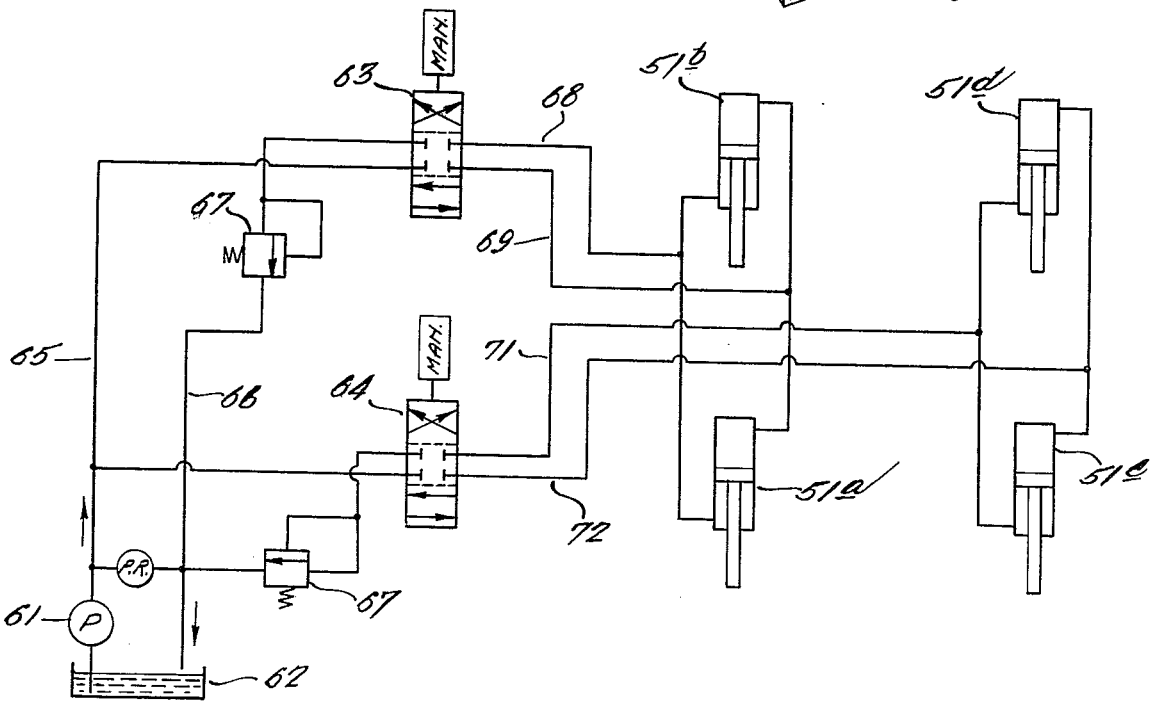
Figure 15:
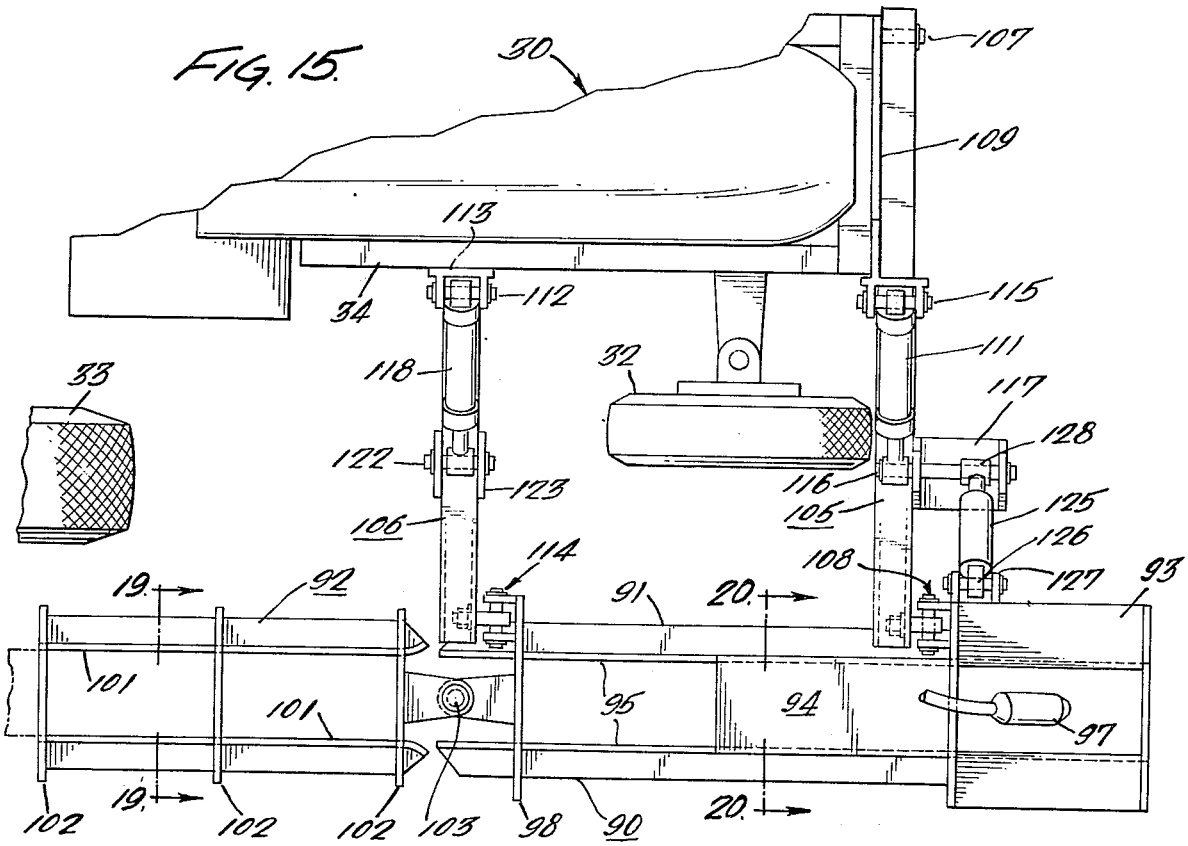
Figure 16:
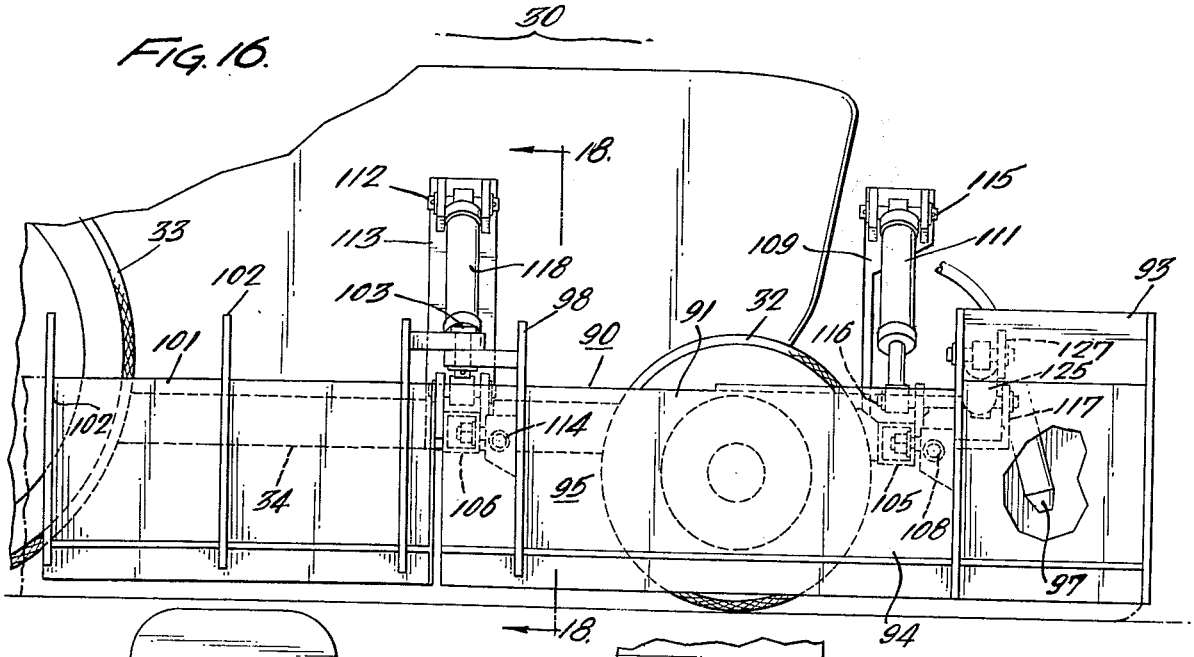
Figure 19:
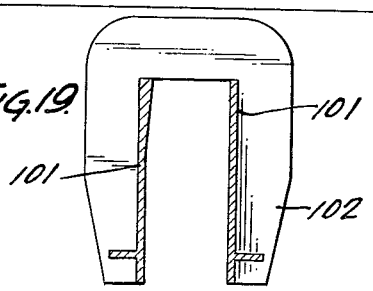
Figure 20:
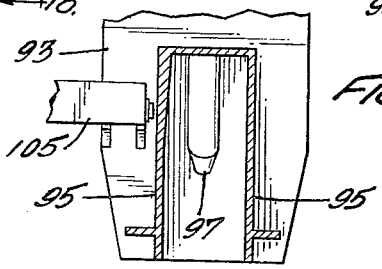
Figure 17:
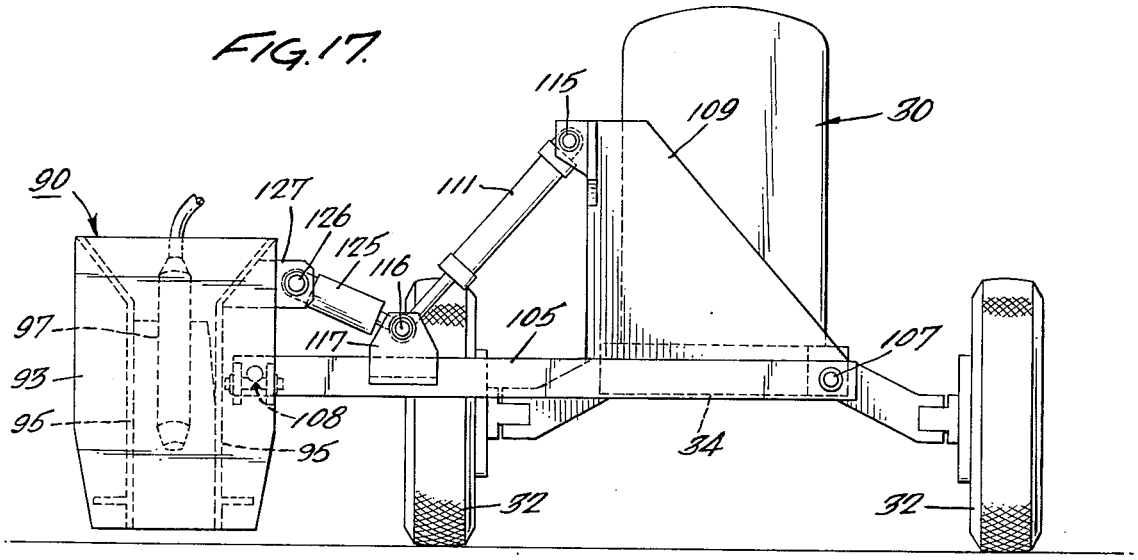
Figure 18:
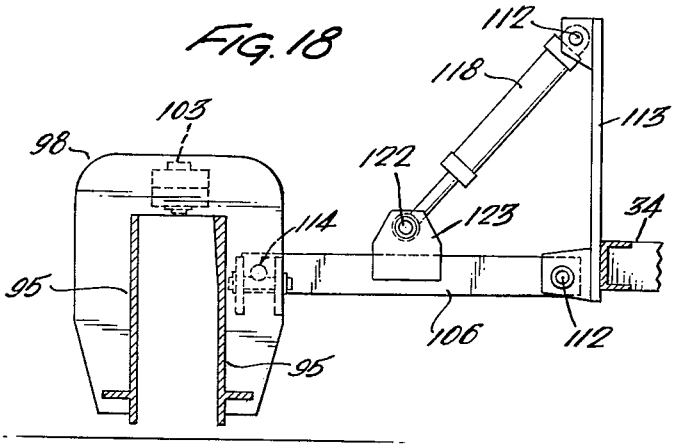
Figure 21:
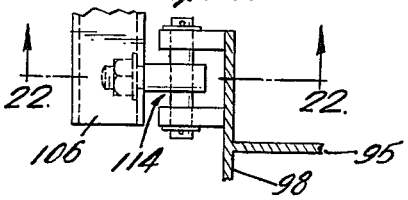
Figure 22:
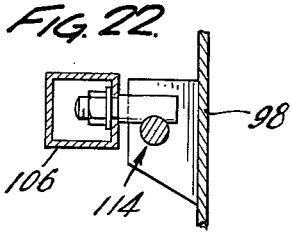
Figure 23:
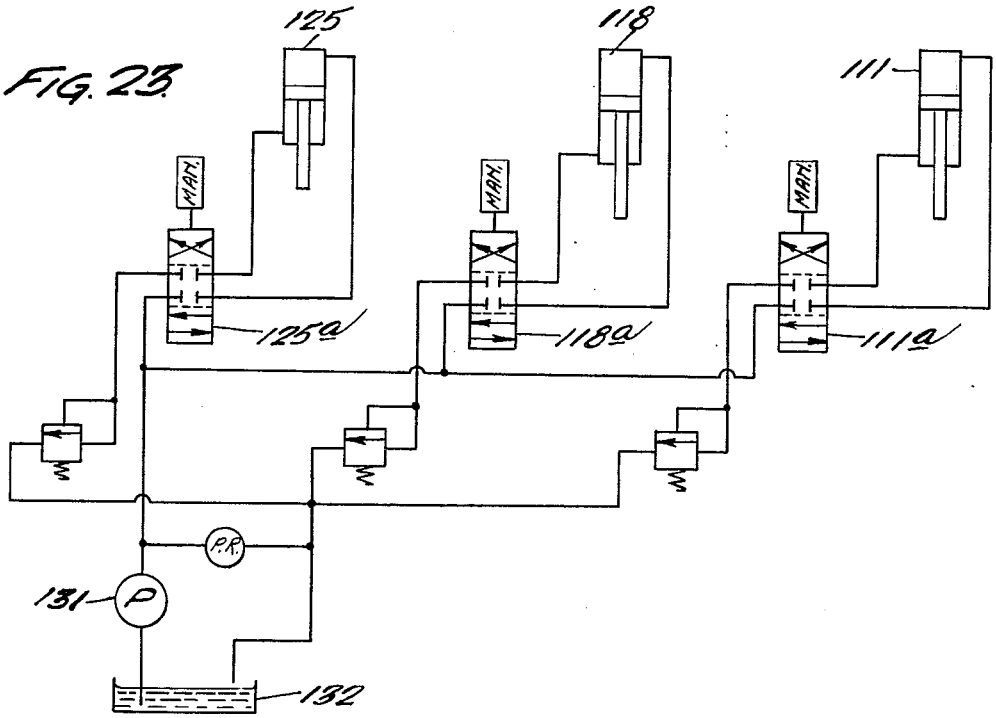

FIGS. 9 and **9*a* are transverse sectional views taken along lines 9—9 and 9*a*—9*a* of FIG. 7**;

FIG. 10 is a front view partially in section as viewed from line 10—10 of FIG. 4, showing the slip mold and means carried by the slip mold for inserting an expansion joint former into the cast concrete;

FIG. 11 is a view similar to FIG. 10 with the expansion joint former partially inserted into the case concrete;

FIG. 12 is a transverse sectional view taken along line 12—12 of FIG. 11;

FIG. 13 is a perspective view of the expansion joint former;

FIG. 14 is a schematic view of a hydraulic circuit for controlling and adjusting the position of the slip mold;

FIG. 15 is a plan view of a modified form of slip mold and mounting means of the present invention;

FIG. 16 is a side elevational view of the apparatus shown in FIG. 15;

FIG. 17 is a front elevational view of the apparatus shown in FIG. 15;

FIG. 18 is a transverse sectional view taken along line 18—18 of FIG. 16;

FIG. 19 is a transverse sectional view of the rear portion of the slip mold taken along line 19—19 of FIG. 15;

FIG. 20 is a transverse sectional view of the front portion of the slip mold taken along line 20—20 of FIG. 15;

FIG. 21 is a fragmentary sectional view illustrating the means for connecting the rear support arm for the slip mold to the slip mold;

FIG. 22 is a fragmentary sectional view taken along line 22—22 of FIG. 21; and FIG. 23 is a schematic illustration of the hydraulic circuit for controlling the position of the slip mold of the embodiment of FIG. 15 of the drawings.

Figure 1:
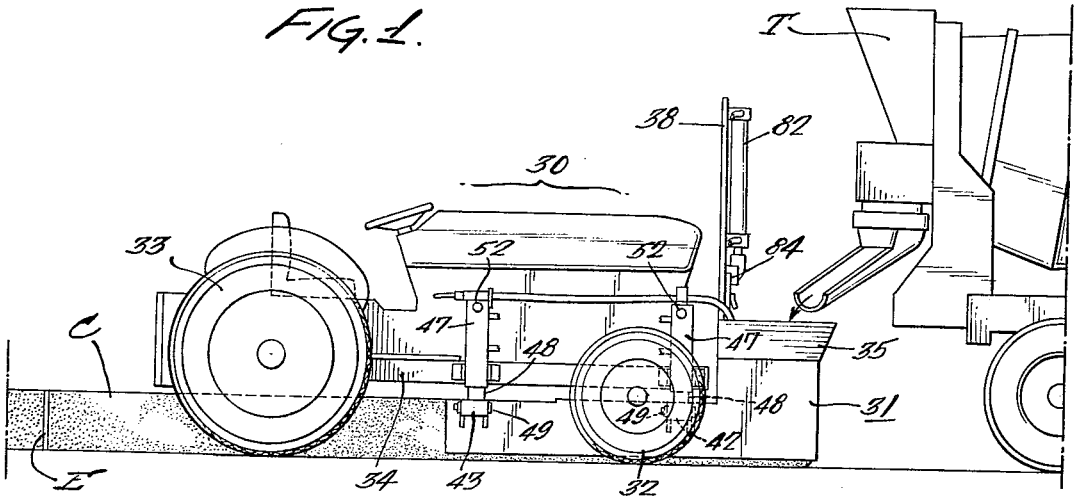
FIG. 1 is a side elevational view of a tractor mounting a slip mold made in accordance with the present invention.

Referring more specifically to the drawings, in FIG. 1 there is illustrated apparatus for continuously casting concrete, including a power driven tractor 30 carrying between its wheels a continuous slip mold 31. The tractor illustrated is a conventional tractor having front and rear wheels 32 and 33 respectively and a support frame 34. In addition, the tractor has added to it between its normal transmission and its differential a second transmission which, when engaged, will provide an additional speed reduction to the tractor so that with the tractor throttle set for the normal operating speed the tractor will travel at the required speed of one to three feet per minute necessary for the continuous casting of concrete utilizing slip molds. However, when the second transmission is disengaged the tractor will travel at its normal road speed, an important factor in that after the tractor has completed the casting of one section of concrete it can travel quickly to the start of a second section.

Figure 6:
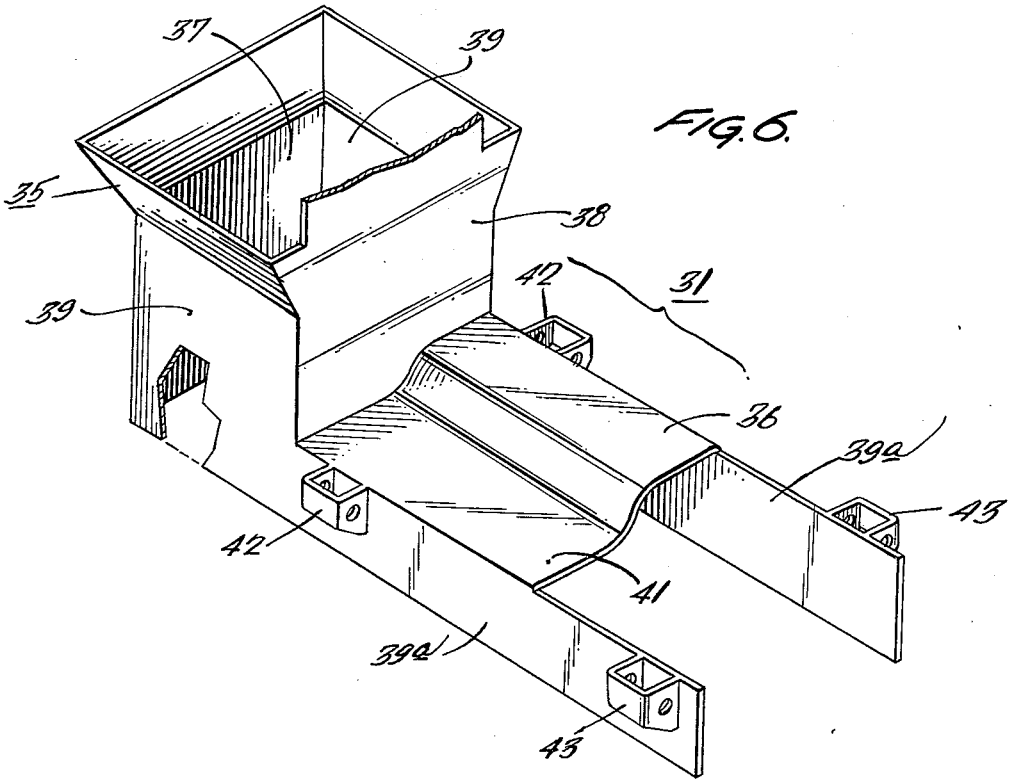
FIG. 6 is a perspective view illustrating one form of slip mold of the present invention.

The slip mold of the present invention is illustrated in FIG. 6, and includes a forward supply hopper section 35 and a rearward mold section 36, both open at their bottom. The supply hopper section includes front and rear walls 37 and 38 and a pair of opposite side walls 39 with the front and side walls having outwardly flared upper end portions to permit a rapid supply of concrete to the hopper. The mold portion is formed by rearward extensions 39*a* of the hopper side walls 39 and a top wall 41 shaped to the desired contour of the article to be cast. The rear wall 38 of the hopper terminates at its lower end and the top wall of the mold to provide uninterrupted communication between the hopper and the mold. Additionally, the upper wall of the mold preferably will terminate short of the rear ends of the mold side walls.

In this embodiment of the invention, the slip mold is shown as a mold for casting concrete gutter sections and the upper wall 41 of the mold is contoured to provide the desired shape to the gutter.

In accordance with the present invention, means are provided to permit quick attachment and detachment of slip molds to the tractor and also to permit adjustment of the position of the slip mold relative to the tractor and the ground both before and during the continuous casting operation. This permits slip molds to be changed rapidly on the job site, if necessary, and allows the operator of the tractor to adjust the position of the mold so that it closely follows the contour of the ground on which the concrete is being cast and to permit tilting of the mold relative to the level of the ground. This is accomplished by the provision of a series of hydraulic cylinders interposed between the tractor support frame 34 and the slip mold in such a manner to permit tilting and vertical movement of the slip mold. To this end, the slip mold of FIG. 6 has front and rear support brackets 42 and 43 respectively secured to each of the opposite side walls of the mold while front and rear mounting brackets 44 and 45 respectively are secured to opposite sides of the tractor support frame 34. When the slip mold is positioned beneath the tractor with the supply hopper in the desired location at the front of the tractor the tractor mounting brackets directly overlie corresponding support brackets of the slip mold.

Figure 8:
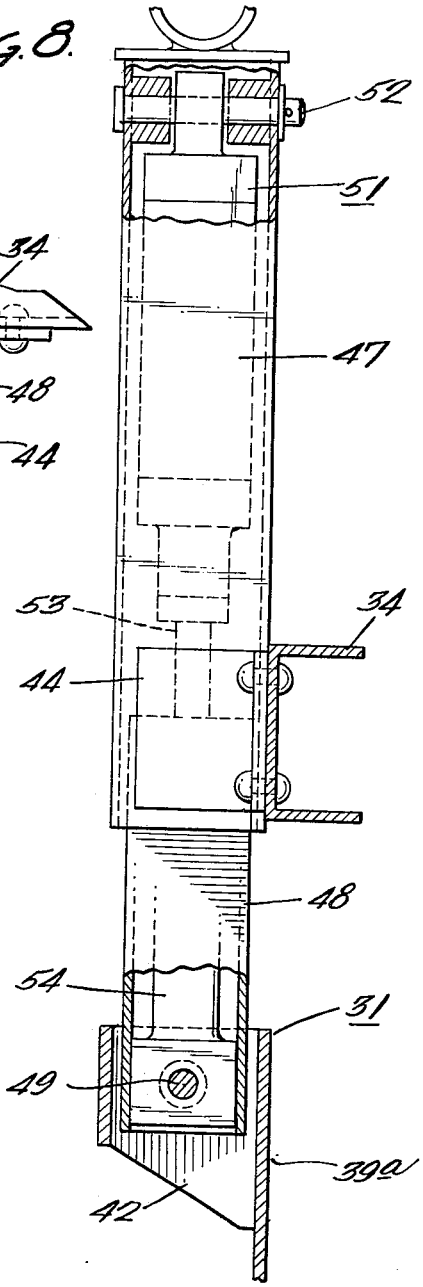
FIG. 8 is a longitudinal sectional view of the apparatus of FIG. 7 taken along line 8—8 of FIG. 7.

FIGS. 7, 8 and 9 illustrate the connection between the tractor and the slip mold at one corresponding pair of mounting and support brackets. It will be understood that the connection at all corresponding pairs of tractor mounting brackets and slip mold support brackets are similar to the one shown in FIGS. 7, 8 and 9. Referring to these figures, the tractor mounting bracket 44 has secured to it an upwardly extending sleeve 47 closed at the upper end and open at its lower end. The sleeve 47 preferably is of square cross-sectional shape and telescopically receives into its lower end with a relatively loose fit an open sleeve 48 which is loosely secured at its lower end to the slip mold support bracket 42, for example, by means of a pin 49 which extends longitudinally of the slip mold and passes through openings in the support bracket 43 and the lower end of the sleeve 48. A hydraulic cylinder 51 is positioned within the upper sleeve 47 and is secured to the upper end of the sleeve 47 by means of a horizontal pin 52 extending at right angles to the direction of the previously described pin 49. This pin 52 extends through openings in the sides of the upper sleeve 47 and through an opening provided in a lug integrally secured to the upper end of the cylinder 51, with a relatively loose or sloppy fit being provided between the pin 52 and the lug opening. To provide a connection between the tractor and the mold, the lower end of the piston rod 53 for the hydraulic cylinder 51 is threadedly received in a T-shaped fitting 54 carried within the lower sleeve 48 by the pin 49. This threaded connection permits an adjustment of the length of the piston rod prior to assembly of the tractor and slip mold. With this construction, after the slip mold has been mounted to the tractor, hydraulic fluid under pressure can be admitted to the bottom or top of the cylinder 51 to retract or extend the piston rod 53 and permit the slip mold to be raised or lowered. Additionally, as more fully described hereinafter, the pair of hydraulic cylinders on one side of the tractor may be operated together and independently of the pair of hydraulic cylinders on the other side of the tractor to cause sideward tilting of the slip mold relative to the tractor and to the ground on which the concrete is being cast. The hydraulic cylinders 51 are controlled in pairs.

FIG. 14 illustrates schematically a hydraulic circuit for operating the hydraulic cylinders in the embodiment of the invention described above. In FIG. 14 there are four hydraulic cylinders illustrated with these cylinders being designated as 51*a* and 51*b* for the front and rear cylinders respectively at the right-hand side of the tractor and 51*c* and 51*d* for the front and rear cylinders respectively on the left-hand side of the tractor. The hydraulic circuit includes a continuously running pump 61 which may be driven by the tractor motor and which pumps hydraulic fluid under pressure from a sump 62 through hydraulic lines to the cylinders. A pair of manually operated control valves 63 and 64 respectively are provided to control the supply of hydraulic fluid to the various hydraulic cylinders. These control valves preferably are spool type valves of conventional construction, such as the Series 21 Valves manufactured by the Vickers Division of the Sperry-Rand Corporation. The valves are normally spring biased to a central "off" position and when moved toward one position will allow passage of hydraulic fluid in a direction to raise the pistons in the cylinders and when moved in the opposite direction will reverse the direction of flow of hydraulic fluid to the cylinders and cause the pistons to be lowered.

As shown in FIG. 14, there is a supply line 65 and a return line 66 to each valve 63 and 64, with the return lines passing through check valves 67, 67. The valve 63 controls operation of the cylinders 51*a* and 51*b* through the hydraulic lines 68, 69 while the valve 64 controls operation of the cylinders 51*c* and 51*d* through the hydraulic lines 71, 72. With this arrangement the pistons of the cylinders may be raised or lowered in pairs at either side of the tractor to raise, lower and tilt the slip mold.

Figure 2:
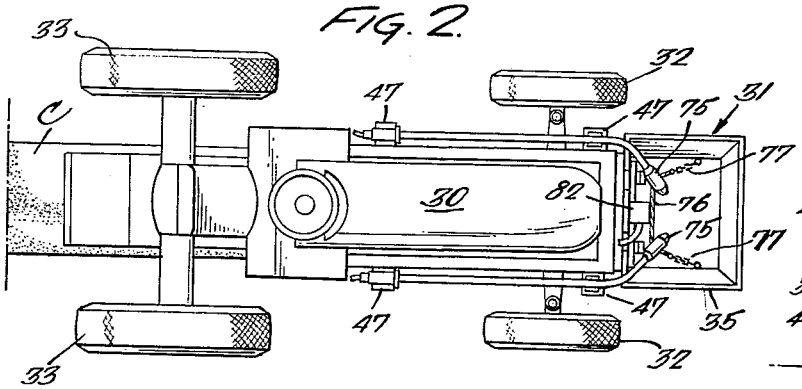
FIG. 2 is a plan view of the tractor and slip mold of FIG. 1.
Figure 3:
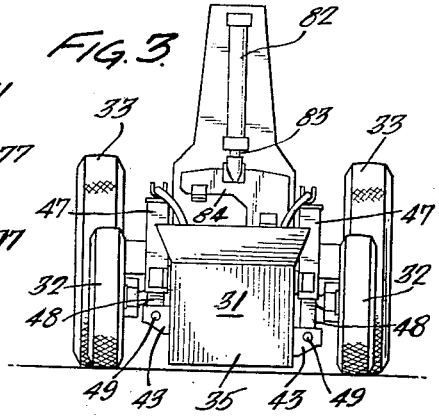
FIG. 3 is a front elevational view of the tractor and slip mold of FIG. 1.

When using the continuous casting apparatus of the present invention the hopper 35 of the slip mold is filled with a relatively dry mixture of concrete and the tractor is caused to move in the forward direction at a slow rate of speed, for example, from one to three feet per minute along the path on which it is desired to form the concrete curbing or gutter C. The concrete passes from the hopper into the mold section of the slip form where it is formed into the desired shape and because of the dry mixture of concrete, the concrete will have very little slump and will retain its cast shape. In operating apparatus of this type it is conventional to have a concrete truck T stay in front of the continuous casting apparatus and pour concrete into the hopper to maintain the level of concrete in the hopper relatively uniform. It is necessary to vibrate the concrete while it is in the hopper to temporarily liquify the concrete before it passes into the mold section of the slip form. Accordingly, a pair of conventional concrete vibrators 75 are suspended in the hopper 35 out of contact with the walls of the hopper. As illustrated in FIGS. 2, 4 and 10, a convenient way of suspending the vibrators 75 within the hopper is by using a piece of shock cord 76 passing under the ends of the vibrators with the shock cord secured to the walls of the hopper by lengths of chain 77.

An important feature of the present invention is the provision of means associated with the slip mold to form expansion joints E in the concrete as the concrete is being cast. Normally when continuously casting concrete, expansion joints are formed in the concrete after it is cast by workmen who will cut slots in the concrete with a power-saw or similar tool and thereafter manually insert the usual resilient expansion materal into the cut joint. However, with the apparatus of the present invention an insert 78 formed of metal or other rigid material is automatically positioned in the concrete at predetermined regular intervals during the casting operation. A workman can follow along behind the casting apparatus and manually remove these metal inserts after the concrete has partially set, thereby leaving an open slot in the concrete which may be filled with the usual material to form an expansion joint.

FIG.13 illustrates an insert 78 designed for use with the slip mold 31 of FIG. 6. This insert 78 has a contoured upper edge 79 shaped to conform to the contour of the top wall 41 of the slip mold and a sharpened lower edge 80 to permit easy passage of the insert through the concrete in the hopper.

As illustrated in FIGS. 10 and 11 of the drawings, the rear wall 38 of the hopper 35 is extended upwardly above the hopper adjacent the front of the tractor and mounts a hydraulic cylinder 82. The lower end of the piston rod 83 of the cylinder carries a pusher plate 84 which is positioned to lie flat against the forward surface of the rear wall of the hopper and engage against the top of the insert 78. A pair of downwardly projecting fingers 85, 85 carried by the pusher plate 84 engage over the top portion of the insert 78 to maintain the top of the insert beneath the pusher plate while a pair of guide members 86, 86 mounted on the side walls of the hopper and spaced from the hopper rear wall a distance equal to the thickness of the insert 78 guide the path of travel of the insert when it is pushed downwardly by the pusher plate. In operation the pusher plate is retracted to its uppermost position as shown in FIG. 10 and an insert 78 is positioned against the rear wall of the hopper beneath the fingers of the pusher plate. The piston of the cylinder 82 is then moved downwardly forcing the insert 78 through the concrete in the hopper to a position in which the upper surface 79 of the insert is below the top wall 41 of the mold section of the slip form. The piston is then raised and the insert 78 remains in position in the cast concrete until it is manually removed at some later time.

FIGS. 15–23 inclusive of the drawings illustrate a modified form of casting apparatus of the present invention which is specifically designed for the casting of high curbing or for casting in locations where the tractor cannot straddle the area on which the concrete is to be cast. In this form of the apparatus of the present invention a tractor 30 carries a slip mold 90 in a position outboard of the wheels of the tractor. The slip mold 90 illustrated in this embodiment of the invention includes a front forming section 91 and a rearward trailing section 92 pivotally connected to the forward section. The forming section of the slip mold inclues a hopper 93 positioned in advance of the front end of the tractor and a mold section 94. The hopper 93 has front, side and rear walls in a manner similar to the hopper 31 of the previously described slip mold and communicates with the mold section 94 to permit ready passage of concrete from the hopper to the mold. The mold in turn has a pair of side walls 95, 95 and a top wall 96 which terminates short of the rear ends of the side walls 95. Also, at least one vibrator 97 is positioned within the hopper to liquify the concrete during the casting operation. The terminal ends of the side walls of the front forming section of the slip mold are held in the desired position by means of an inverted U-shaped yoke 98 which is fastened to an outer surface of the side plates 95 of the mold and spans across the top of the space between the side plates.

The trailing section 92 of the slip mold includes a pair of side plates 101, 101 spaced apart a distance equal to the spacing of the side plates 95 of the forward sections and held in this desired spacing by a series of inverted U-shaped yokes 102. The forward ends of the side plates 101 are flared outwardly as illustrated in FIG. 15 immediately adjacent the trailing ends of the side plates 95 and no top forming plate is provided on this trailing section. A pivoted coupling 103 is provided between the forward and rearward sections of the slip form as illustrated in FIGS. 15 and 16 so that the trailing section will track immediately behind the forward section of the slip mold. This slip mold construction is particularly suited for use in forming curbs along a radius in that the trailing section of the slip mold can pivot from a point on the longitudinal axis of the forward section and follow along the track of the forward section.

The slip mold of this embodiment of the invention is carried by the support frame 34 of the tractor 30 at one side of the tractor. As illustrated in FIGS. 15 and 17 of the drawings, forward and rearward support beams 105 and 106 are provided interconnecting the tractor and the forward section of the mold. The forward support beam 105 is pivoted at its inner end as indicated at 107 to the tractor support frame 34 at the opposite side of the tractor from the mold and extends completely across the front of the tractor to the mold. A universal coupling 108 is provided interconnecting the outer end of the forward support beam with the forward end of the front mold section. Positioned intermediate the tractor support frame 34 and the beam 105 and fixed to the support frame 34 and the beam 105 and fixed to the support frame is a mounting plate 109 for a hydraulic cylinder 111, more fully described hereinafter. As the support beam 105 pivots about its pivot 107 it remains in engagement with the front face of the mounting plate 109 so that forward movement of the tractor exerts a force along the length of the inner segment of the support beam 105 to move the hopper 93 and mold 90 along with the tractor. The rear support beam 106 is pivoted at its inner end as indicated at 112 to a bracket 113 carried by the tractor support frame 34 and is pivotally connected at its outer end by means of a universal coupling 114 to the yoke 98 at the rearward end of the front mold section 91. The universal coupling 114 is similar to the previously described universal coupling 108 and is illustrated in FIGS. 21 and 22 of the drawings. This coupling permits pivotal movement between the support beam and the mold, both about an axis extending longitudinally of the support beam and an axis extending transversely of the support beam.

The front hydraulic cylinder 111 is pivotally connected to a flange at the upper end of the mounting plate 109 as indicated at 115 and has the outer end of its piston pivotally connected as indicated at 116 to a flange 117 secured to the forward support beam 105 at a point on the beam midway between the tractor and the mold. With this construction the hydraulic cylinder 111 can cause the forward support beam 105 to pivot upwardly or downwardly about its pivot 107 and thereby raise or lower the forward end of the front forming section of the slip mold 90. Similarly, a hydraulic cylinder 118 is provided having one end pivotally connected as indicated at 112 to a flange 113 extending upwardly from the tractor support frame 34, as shown in FIGS. 15 and 18. The piston of the hydraulic cylinder is pivotally connected as indicated at 122 to a flange 123 provided on the rear support beam 106 at a point midway between the side of the tractor and the mold. The hydraulic cylinder 118 will cause the rear support beam 106 to pivot upwardly or downwardly about its pivot 112 and raise or lower the rear portion of the front forming section 91 of the slip mold 90.

In accordance with the present invention a third hydraulic cylinder 125 is provided to cause tilting movement of the slip mold 90 about an axis parallel to the longitudinal axis of the mold. This cylinder 125 controls the vertical alignment of the mold, pivoting the mold about the axes of the universal couplings 108 and 114. This hydraulic cylinder has its one end pivotally connected, as indicated at 126, to a flange 127 projecting outwardly from the upper part of the forward end of the front forming section 91 of the slip mold and the piston of the cylinder 125 is pivotally connected as indicated at 128 to the previously described flange 117.

FIG. 23 of the drawings illustrates schematically a hydraulic circuit for operating the hydraulic cylinders 111, 118 and 125 of this embodiment of the invention. This hydraulic circuit includes a continuously running pump 131 which may be driven by the tractor motor and which pumps hydraulic fluid under hydraulic pressure from a sump 132 through hydraulic lines to the cylinders 111, 118 and 125. Manually operated control valves 111*a*, 118*a* and 125*a* are provided for each of the cylinders 111, 118 and 125. These control valves are of the same construction as the previously described control valves 63 and 64 and are normally spring biased to a central off position. They may be moved in opposite directions from the off position to raise and lower the front and rear ends of the forward section of the slip mold independently and to tilt both the forward and trailing sections of the slip mold about an axis parallel to the longitudinal axis of the mold. Thus the mold may be raised, lowered and tilted either before or during the casting operation to adjust for variations of contour of the land on which the curbing is being cast.

From the foregoing it will be observed that the present invention provides a novel machine for continuously casting concrete by means of a slip mold whose position can be readily and easily adjusted during operation of the machine to cast the concrete in the desired position on the ground regardless of the variations in the contour of the ground and during the casting operation from expansion joints in the cast concrete. Additionally, it will be seen that the present invention provides a novel machine of this type which is of relatively inexpensive construction and extremely versatile in operation.

While particular embodiments of the present invention have been illustrated and described herein, it is not intended to limit the invention to such a disclosure and changes and modifications may be incorporated and embodied therein within the scope of the following claims.

I claim:

1. Apparatus for the continuous casting of concrete by the slip mold method comprising:

self propelled tractor means, a support frame rigidly mounted on said tractor means so as to preclude relative movement therebetween, a slip mold having top and side walls and an open bottom, a hopper having front, rear and side walls at the front of said slip mold in communication with slip mold for supplying concrete to the slip mold, said slip mold being mounted beneath the tractor and extending in a direction longitudinally of the tractor with the hopper projecting upwardly from the slip mold in front of the tractor, mounting means for said slip mold for adjustably mounting said slip mold to said tractor in a position extending lengthwise of the tractor with the hopper projecting in front of the tractor, said mounting means including a pair of hydraulic cylinders provided on each side of the tractor interconnecting the support frame and the slip mold with one cylinder of each pair connected to the front of the slip mold and the other cylinder of each pair connected to the rear of the slip mold, said hydraulic cylinders being operable to raise and lower said slip mold and hopper and tilt the same from side to side, and control means for said hydraulic cylinders to control operation of said hydraulic cylinders.

2. Apparatus in accordance with claim 1 in which the control means for said hydraulic cylinders includes a pair of manually operated valves, one valve for each of said pairs of hydraulic cylinders, said valves being operable independently or together to raise and lower the front and rear of said slip mold and tilt said slip mold.

3. Apparatus in accordance with claim 1 including a first enclosed sleeve for each of said hydraulic cylinders, said first sleeves being fixed to said support frame and projecting vertically upwardly therefrom, said hydraulic cylinders being pivotally connected at their upper ends to the upper ends of said first sleeves and loosely carried therein for movement about a first axis, and a second sleeve for each of said hydraulic cylinders pivotally connected to said slip mold and projecting upwardly therefrom and telescopically received within said first sleeves, each of said hydraulic cylinders having a piston and piston rod with the end of the piston rod pivotally connected to the point of attachment of said second sleeve with said slip mold for movement about a second axis extending generally at a right angle to said first axis.

4. Apparatus for the continuous casting of concrete by the slip mold method comprising:

self propelled tractor means, a support frame rigidly mounted on said tractor means so as to preclude relative movement therebetween, a slip mold having top and side walls and an open bottom, a hopper having front, rear and side walls at the front of said slip mold in communication with said slip mold for supplying concrete to the slip mold, mounting means for said slip mold for adjustably mounting said slip mold to said tractor in a position extending lengthwise of the tractor with the hopper projecting in front of the tractor, said mounting means including a plurality of hydraulic cylinders operable to raise and lower said slip mold and hopper and tilt the same from side to side, a first enclosed sleeve for each of said hydraulic cylinders, said first sleeves being fixed to said support frame and projecting vertically downwardly therefrom, said hydraulic cylinders being pivotally connected at their upper ends to the upper ends of said first sleeves and loosely carried therein for movement about a first axis, and a second sleeve for each of said hydraulic cylinders pivotally connected to said slip mold and projecting upwardly therefrom and telescopically received within said first sleeves, each of said hydraulic cylinders having a piston and piston rod with the end of the piston rod pivotally connected to the point of attachment of said second sleeves with said slip mold in movement about a second axis extending generally at a right angle to said first axis, and control means for said hydraulic cylinder to control operation of said hydraulic cylinders.

* * * * *